US006986616B2

(12) United States Patent
Lee

(10) Patent No.: US 6,986,616 B2
(45) Date of Patent: Jan. 17, 2006

(54) PAPER GUIDE FOR AN INK-JET PRINTER AND INK-JET PRINTER HAVING THE SAME

(75) Inventor: Seung-jae Lee, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/601,573

(22) Filed: Jun. 24, 2003

(65) Prior Publication Data

US 2004/0085427 A1 May 6, 2004

(30) Foreign Application Priority Data

Oct. 31, 2002 (KR) ..... 10-2002-0067060

(51) Int. Cl.
*B41J 11/02* (2006.01)
*B41J 11/08* (2006.01)

(52) U.S. Cl. ..... 400/656; 400/648; 347/104

(58) Field of Classification Search ..... 400/656, 400/648, 642; 347/104
See application file for complete search history.

(56) References Cited

U.S. PATENT DOCUMENTS 5,515,094 A * 5/1996 Tanaka et al. ..... 347/104
5,775,824 A * 7/1998 Bae ..... 400/636
5,847,719 A * 12/1998 Yamaguchi et al. ..... 347/104
6,089,773 A * 7/2000 Bailey et al. ..... 400/642
6,457,888 B1 * 10/2002 Matsumoto ..... 400/625
2002/0089564 A1 * 7/2002 Ohashi ..... 347/41
2002/0118266 A1 * 8/2002 Yamaguchi et al. ..... 347/104
2002/0171727 A1 * 11/2002 Kida et al. ..... 347/104
2003/0025777 A1 * 2/2003 Sugiyama ..... 347/104
2003/0043248 A1 * 3/2003 Samoto et al. ..... 347/104

FOREIGN PATENT DOCUMENTS

JP 2002103706 A * 4/2002
JP 2003072111 A * 3/2003
KR 1999-40963 6/1999

* cited by examiner

*Primary Examiner*—Daniel J. Colilla
(74) *Attorney, Agent, or Firm*—Staas & Halsey LLP

(57) ABSTRACT

A paper guide used in an ink-jet printer. The paper guide for the ink-jet printer includes a plurality of first guide ribs which protrude on the paper guide to face a front-half swath of a printhead and forms a predetermined interval therebetween, and a plurality of second guide ribs which protrude on the paper guide to face a rear half-swath of the printhead and forms an interval therebetween to be wider than the interval between the first guide ribs.

6 Claims, 3 Drawing Sheets

PAPER GUIDE FOR AN INK-JET PRINTER AND INK-JET PRINTER HAVING THE SAME

CROSS-REFERENCE TO RELATED APPLICATIONS

This application claims the benefit of Korean Patent Application No. 2002-67060, filed on Oct. 31 2002, in the Korean Intellectual Property Office, the disclosure of which is incorporated herein by reference.

BACKGROUND OF THE INVENTION

1. Field of the Invention

The present invention relates to a paper guide used with an ink-jet printer and an ink-jet printer having the same, by which when multi-pass printing is performed to improve printing quality of an ink-jet printer, a first printing portion of a paper is flattened and a waveform size of a second printing portion of the paper is reduced.

2. Description of the Related Art

An ink-jet printer includes a paper guide on which a material used in printing e.g., paper supplied from a feed roller is to be placed and flattened. A paper guide rib is provided on the paper guide so as to be parallel with a paper feeding direction.

FIG. 1 is a cross-sectional view schematically illustrating the structure of an ink-jet printer having a conventional paper guide. Referring to FIG. 1, a friction roller 14 contacts a feed roller 10 which receives paper P supplied from a pickup roller (not shown) on a paper path and feeds the paper P by an amount (swath S) which corresponds to a printing area. The friction roller 14 is rotatably connected to one end of a friction roller holder 15, and the other end of the friction roller holder 15 is connected to a printer body. The feed roller 10 comprises a rubber roller 12 coupled to a metal shaft 11, and a gear (not shown) is coupled at an end of the shaft 11 to connect with the power of a driving motor (not shown). The friction roller 14 contacts the circumference of the feed roller 10. The friction roller 14 applies a predetermined pressure to the feed roller 10 by a weight of the friction roller holder 15. If the feed roller 10 is rotated by a driving motor (not shown), the friction roller 14 is rotated by a rotation of the feed roller 10.

An ink-jet cartridge 20 and a paper guide 30 are disposed downstream of the feed roller 10 in a paper path. The paper guide 30 is spaced apart downwardly from a printhead 21 under the ink-jet cartridge 20 by a predetermined gap G, and supports the paper P thereon.

FIG. 2 is a plane view illustrating paper guide ribs 32, illustrated in FIG. 1 in cross-section only, disposed on the paper guide. Referring to FIG. 2, ribs 32 are placed at a predetermined interval I with the interval I spacing from 5–20 mm, and parallel with a paper path. The paper guide rib 32 is formed to a height of about 1–2 mm above the paper guide surface (30*a*) such that the paper P does not contact directly the surface 30*a* of the paper guide 30 and supports the paper P to be flattened during a printing.

A plurality of holes 35 are formed in a rear portion of the paper guide 30 downstream of the printhead 21, a paper output roller 40 is placed in each of the plurality of holes 35, and a star wheel 42 is provided on the paper output roller 40.

Printing steps of an ink-jet printer having the above structure will be described in detail with reference to FIGS. 1 and 2.

First, the paper P supplied from the pickup roller (not shown) is fed between the rotating friction roller 14 and the feed roller 10 in a feed direction as illustrated. If the paper P is fed by a friction force between the feed roller 10 and the paper P, the paper P is entered into the paper path by a distance of one swath S at the same velocity as a linear velocity of the circumference of the rubber roller 12. In this case, the paper P is fed toward the printhead 21 and is printed on by the printhead 21, which receives a printing file from a controller (not shown), and ejects ink, and subsequently, printing is performed while the feed roller 10 feeds the paper P by one swath S. If it is determined from the controller that the printing is terminated, the paper output roller 40 outputs the paper P.

However, when multi-pass printing is performed by an inkjet printer having the paper guide having the above structure so as to attempt to print a high-quality image, the feed roller 10 feeds the paper P by a distance of a half-swath S to the paper path. Thus, the swath S may include a front-half part S1 and a rear-half part S2 which each correspond to a half-swath S. After a first printing is performed at the front-half part S1, the paper P is fed by a half-swath S and a second printing is performed on the first-printed portion at the rear-half part S2 in a state when ink on the first-printed portion is not yet dried. Thus, the second printing is performed at a position different from a target position due to an excessive waveform (see the paper P marked by a dotted line W1 of FIG. 5) of the first-printed portion of the paper P at the rear-half part. As a result, printing quality is lowered, and a protruded portion of the first-printed portion of the paper P contacts the printhead 21 and is smeared by the printhead 21.

SUMMARY OF THE INVENTION

The present invention provides a paper guide used with an ink-jet printer and an ink-jet printer having the same, by which when multi-pass printing is performed by an ink-jet printer, the paper is flattened by a paper guide rib at a front-half part which is a first printing area of the paper and the paper is prevented from being contaminated by contacting a printhead when a second printing is performed, because a printed portion is not protruded at a rear-half part of the paper guide which is a second printing area of the paper.

According to one aspect of the present invention, there is provided a paper guide used with an ink-jet printer. The paper guide used with an ink-jet printer includes a plurality of first guide ribs which protrude on the paper guide to face a front-half swath of a printhead, the first guide ribs with a predetermined interval therebetween, and a plurality of second guide ribs which protrude on the paper guide to face a rear-half swath of the printhead, the second guide ribs with an interval therebetween to be wider than the interval between the first guide ribs.

According to one aspect of the present invention, each of the second guide ribs is linearly connected to the corresponding first guide rib, and at least one first guide rib is further formed between the first guide ribs connected to the corresponding second guide rib.

Additional aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments accompanying drawings in which.

DETAILED DESCRIPTION OF THE PREFERRED EMBODIMENTS

Figure 1:
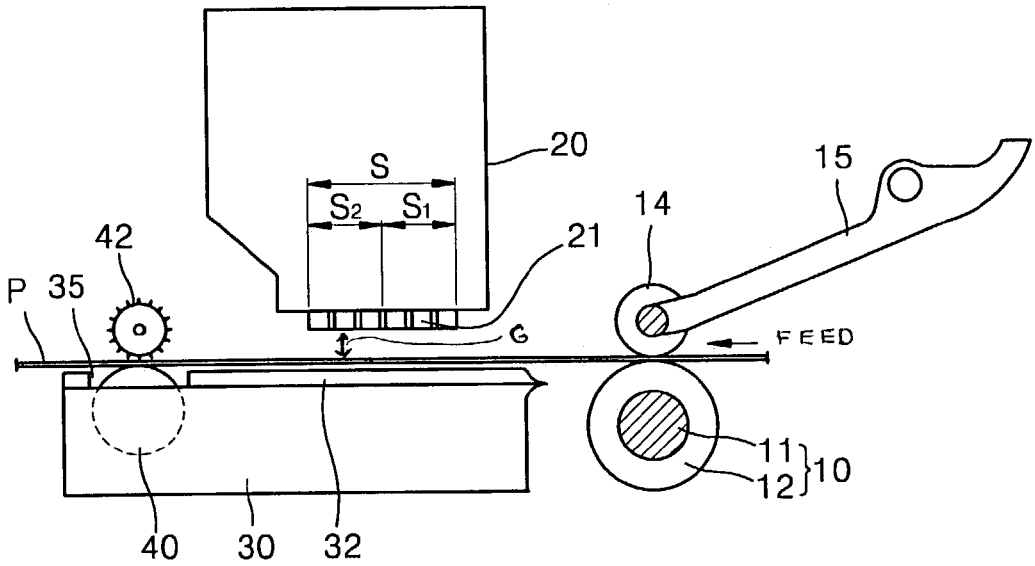
FIG.1 (PRIOR ART)
FIG. 1 is a cross-sectional view schematically illustrating the structure of an ink-jet printer having a conventional paper guide.
Figure 2:
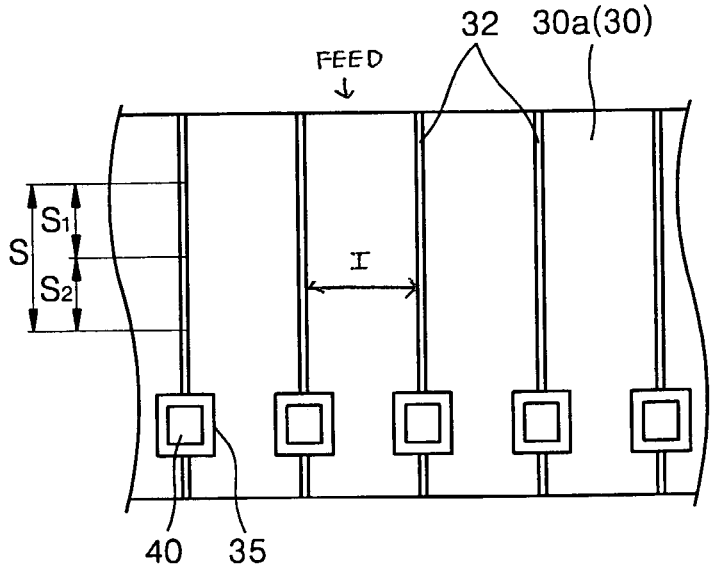
FIG.2 (PRIOR ART)
FIG. 2 is a plane view illustrating conventional paper guide ribs disposed on the paper guide of FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures. Thicknesses of layers or regions shown in drawings are exaggerated for clarity of a specification.

Figure 3:
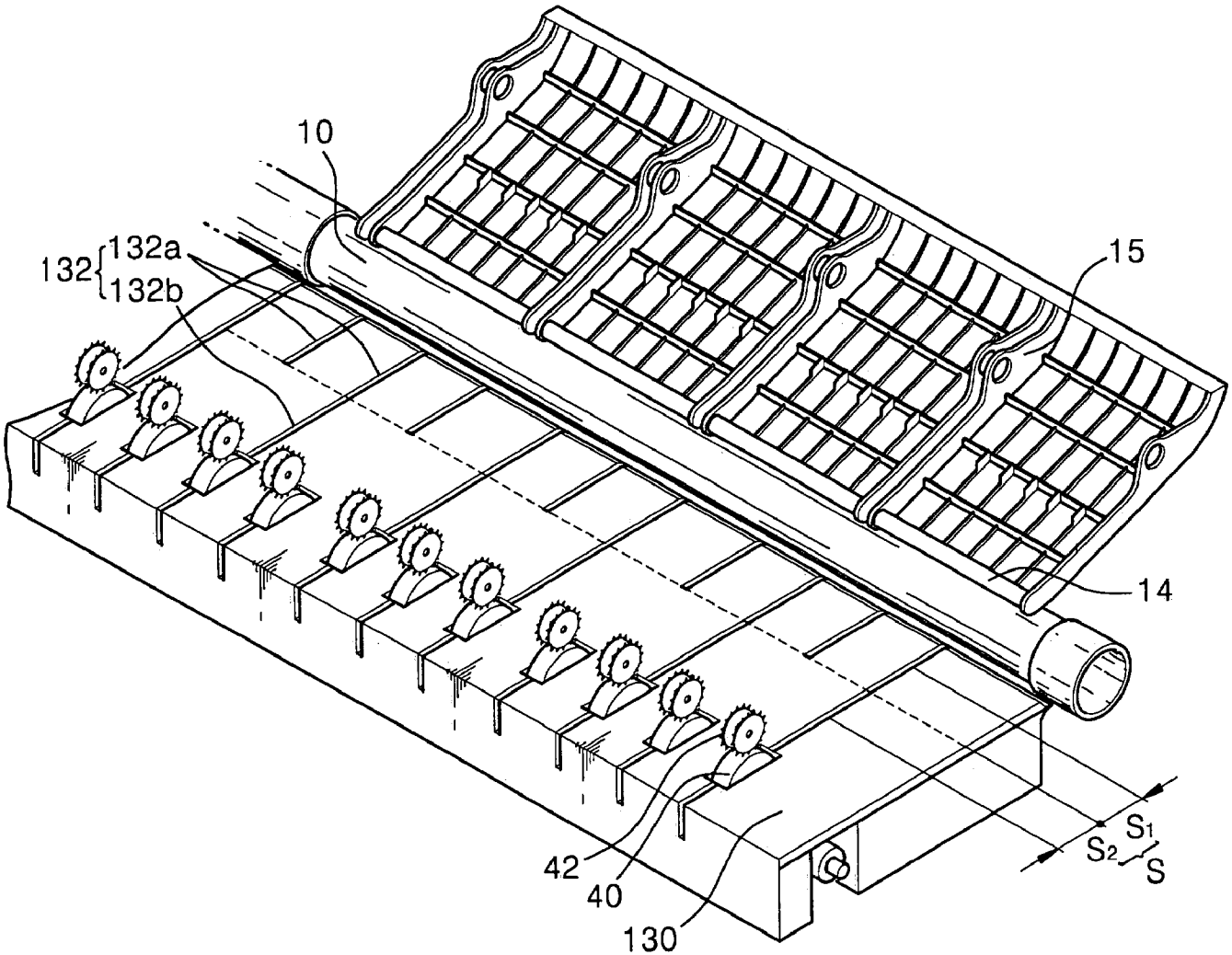
FIG. 3 is a perspective view illustrating an embodiment of a paper guide for an ink-jet printer according to the present invention.
Figure 4:
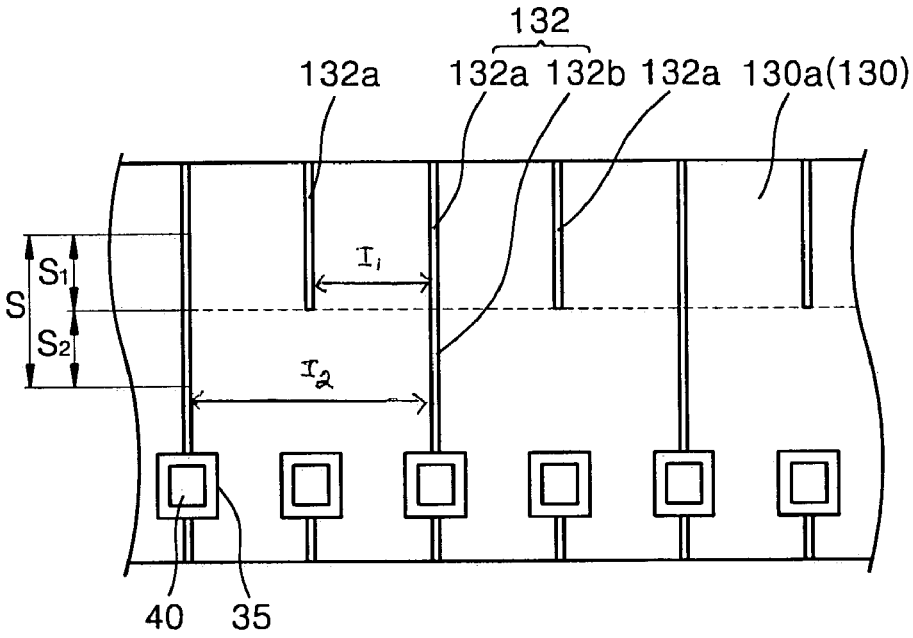
FIG. 4 is a plane view illustrating paper guide ribs disposed on the paper guide of FIG. 3.

FIG. 3 is a perspective view illustrating an embodiment of a paper guide for an ink-jet printer according to the present invention, and FIG. 4 is a plane view illustrating paper guide ribs disposed on the paper guide of FIG. 3. The same reference numerals refer to like elements, and descriptions thereof will be omitted.

Referring to FIG. 3, a friction roller 14 contacts a feed roller 10 which receives paper P, supplied from a pickup roller (not shown) on a paper path and feeds the paper P by an amount (swath) which corresponds to a printing area. The friction roller 14 is rotatably connected to one end of a friction roller holder 15, and the other end of the friction roller holder 15 is connected to a printer body. The friction roller 14 contacts the circumference of the feed roller 10. The friction roller 14 applies a predetermined pressure to the feed roller 10 by a weight of the friction roller holder 15. If the feed roller 10 is rotated by a driving motor (not shown), the friction roller 14 is rotated by a rotation of the feed roller 10.

An ink-jet cartridge 20 and a paper guide 130 are disposed downstream of the feed roller 10 on a paper path. The paper guide 130 is spaced apart downwardly from a printhead 21 under the ink-jet cartridge 20 by a predetermined gap to support the paper P thereon.

Referring to FIG. 4, a plurality of paper guide ribs 132 are formed on the paper guide 130 so as to be parallel with a paper path. The paper guide ribs 132 include first guide ribs 132*a* formed at a front-half part S1 of a swath S in which a first printing is performed during a multi-pass printing, and second guide ribs 132*b* formed in a rear-half part S2 of the swath S in which a second printing is performed. A feature of the present invention is that the interval I1 between the first guide ribs 132*a* where the first printing is performed is narrower than the interval I2 between the second guide ribs 132*b* where the second printing is performed.

The paper guide rib 132 is formed to a height of about 1–2 mm such that the paper P does not contact directly a top surface 130*a* of the paper guide 130 and supports the paper P to be flattened during a printing.

Each of the second guide ribs 132*b* can be linearly connected to a corresponding first guide rib 132*a*, and one first guide rib 132*a* can be further formed between the first guide ribs 132*a* connected to the second guide rib 132*b* as illustrated in FIG. 4.

Although each of the second guide ribs 132*b* is shown as connected to a first guide rib 132*a* in the present embodiment, the present invention is not limited to this. Also, the present invention is not limited so that only one first guide rib 132*a* disposed between the first guide ribs 132*a* that are connected to the second guide ribs 132*b*.

A plurality of holes 35 are formed in a rear end of the paper guide 130, and paper exhausting rollers 40 are placed in each of the plurality of holes 35, and a star wheel 42 is provided on the paper exhausting roller 40.

Multi-pass printing operations of an ink-jet printer having the above structure will be described in detail with reference to FIGS. 3 and 4.

First, the paper P supplied from the pickup roller (not shown) is fed between the rotating friction roller 14 and the feed roller 10. If paper P is fed by a friction force between the feed roller 10 and the paper P, the paper P is entered into the paper path by a half-swath S at the same velocity as a linear velocity of the circumference of the rubber roller 12. In this case, the paper P fed toward the printhead 21 is first printed on by the printhead 21 which receives a printing file from a controller (not shown) and ejects ink. In this case, a first printing is performed in a state when the paper P placed on the first guide ribs 132*a* is flattened by the first guide ribs 132*a* formed at a comparatively narrow interval I1, and thus printing quality is improved.

Figure 5:
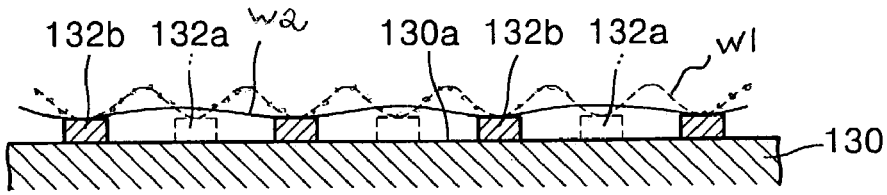
FIG. 5 illustrates the function of a second guide rib.

Subsequently, the paper P in which the first printing is completed is fed by another half-swath S, a first-printed portion is moved to the rear-half part S2, and multi-pass printing is performed on the first-printed portion of the paper. In this case, the first-printed portion placed on the second guide ribs 132*b* is depressed between the second guide ribs 132*b*, formed at a comparatively wide interval I2, by its weight, and is flattened as by the solid line W2 in FIG. 5, such that the height of the waveform is reduced. That is, the dotted line W1 of FIG. 5 indicates a case where the interval between the second guide ribs 132*b* is narrow e.g., the same as I1, and the solid line of FIG. 5 indicates a case where the interval between the second guide ribs 132*b* is wide e.g., I2. Thus, a multi-pass printing is performed on the first-printed portion which is flattened such that printing quality is improved. Subsequently, the printing is continuously performed while the feed roller 10 feeds the paper P by the half-swath S. If it is determined from the controller that the printing is terminated, the paper output roller 40 outputs the paper P.

As described above, the paper guide of the ink-jet printer according to the present invention, by preventing a first-printed portion from forming an excessive waveform during a second printing when multi-pass printing is performed, can prevent a printhead from smearing the printing and improve printing quality.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A paper guide of an ink-jet printer, comprising:

a plurality of first guide ribs positioned to protrude from the paper guide to face a front-half swath of a printhead with an equal, first interval therebetween; and a plurality of at least three second guide ribs positioned to protrude from the paper guide to face a rear-half swath of the printhead with an equal, second interval therebetween each of the adjacent second guide ribs wider than the first interval between the first guide ribs, wherein each of the second guide ribs is connected to a corresponding first guide rib, and ribs do not extend into the interval between the second guide ribs.

2. The paper guide of claim 1, wherein each of the second guide ribs is linearly connected to a corresponding first guide rib.

3. The paper guide of claim 2, wherein at least one first guide rib is positioned between the first guide ribs connected to a corresponding second guide rib.

4. An ink-jet printer, comprising:

an ink-jet cartridge with a printhead; and a paper guide, wherein the paper guide comprises:

a feed roller, and a plurality of first guide ribs and a plurality of at least three second guide ribs, wherein the plurality of first guide ribs are positioned to protrude from the paper guide to face a front-half swath of the printhead with an equal, first interval therebetween, and the plurality of second guide ribs protrude on the paper guide to face a rear-half swath of the printhead with an equal, second interval therebetween each of the adjacent second guide ribs to be wider than the interval between the first guide ribs.

wherein each of the second guide ribs is connected to a corresponding first guide rib, and ribs do not extend into the interval between the second guide ribs.

5. The printer of claim 4, wherein each of the second guide ribs is linearly connected to a corresponding first guide rib.

6. The printer of claim 5, wherein at least one first guide rib is positioned between the first guide ribs connected to a corresponding second guide rib.

* * * * *

UNITED STATES PATENT AND TRADEMARK OFFICE

CERTIFICATE OF CORRECTION

PATENT NO. : 6,986,616 B2
APPLICATION NO. : 10/601573
DATED : January 17, 2006
INVENTOR(S) : Seung-jae Lee It is certified that error appears in the above-identified patent and that said Letters Patent is hereby corrected as shown below:

On the title Page: Column 2, line 1, (Foreign Patent Documents), after "4/2002", insert --B41J 11/02--;

On the title Page: Column 2, line 2, (Foreign Patent Documents), after "3/2003", insert --B41J 02/18--;

On the title Page: Column 2, line 6, Abstract, (Abstract), replace "rear half-swath" with --rear-half swath--, therefor.

Column 6, line 8, Claim 4, replace "ribs." with --ribs,--, therefor.

Signed and Sealed this

Twenty-second Day of August, 2006

JON W. DUDAS
*Director of the United States Patent and Trademark Office*